US010144997B2

(12) United States Patent
Hashimoto et al.

(10) Patent No.: US 10,144,997 B2
(45) Date of Patent: Dec. 4, 2018

(54) 7XXX SERIES ALUMINUM ALLOY MEMBER EXCELLENT IN STRESS CORROSION CRACKING RESISTANCE AND METHOD FOR MANUFACTURING THE SAME

(71) Applicant: Kobe Steel, Ltd., Kobe-shi (JP)

(72) Inventors: Narikazu Hashimoto, Shimonoseki (JP); Takahiro Shikama, Shimonoseki (JP); Tsunetake Tsuyoshi, Shimonoseki (JP)

(73) Assignee: KOBE STEEL, LTD., Kobe-shi (JP)

( * ) Notice: Subject to any disclaimer, the term of this patent is extended or adjusted under 35 U.S.C. 154(b) by 0 days.

(21) Appl. No.: 15/809,538

(22) Filed: Nov. 10, 2017

(65) Prior Publication Data

US 2018/0087139 A1 Mar. 29, 2018

Related U.S. Application Data

(62) Division of application No. 14/132,381, filed on Dec. 18, 2013.

(30) Foreign Application Priority Data

Jan. 30, 2013 (JP) ..... 2013-015456

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC ..... C22C 21/10; C22F 1/053
(Continued)

(56) References Cited

U.S. PATENT DOCUMENTS

2009/0191090 A1 7/2009 Makino
2014/0102601 A1* 4/2014 Yoshida ..... B21C 23/002 148/550

(Continued)

FOREIGN PATENT DOCUMENTS

JP 7-25296 1/1995
JP 7-305151 11/1995

(Continued)

OTHER PUBLICATIONS

English language machine translation to WO 2012165086. Generated May 30, 2017.

(Continued)

*Primary Examiner* — Brian D Walck
(74) *Attorney, Agent, or Firm* — Oblon, McClelland, Maier & Neustadt, L.L.P.

(57) ABSTRACT

An aluminum alloy member resistant to cracking and having high strengths and excellent stress corrosion cracking resistance is manufactured by crushing a 7xxx aluminum alloy extrudate. Specifically, a 7xxx aluminum alloy extrudate containing Zn of 3.0-8.0%, Mg of 0.4-2.5%, Cu of 0.05-2.0%, and Ti of 0.005-0.2%, in mass percent, and prepared through press quenching is subjected to a reversion treatment, to crushing within 72 hours after the reversion treatment, and then to aging. The reversion treatment includes heating at a temperature rise rate of 0.4° C./second or more, holding in a temperature range of 200-550° C. for longer than 0 second, and cooling at a rate of 0.5° C./second or more. The ratio of the tensile residual stress $\sigma_{rs}$ to the 0.2% yield stress $\sigma_{0.2}$ after aging and the total content X of Mg and Zn satisfy a condition specified by Expression (1):

$$Y \leq -0.1X + 1.4 \quad (1).$$

16 Claims, 2 Drawing Sheets

(58) Field of Classification Search
USPC ..... 148/417, 439, 695
See application file for complete search history.

(56) References Cited

U.S. PATENT DOCUMENTS

| | | | |
|---|---|---|---|
| 2014/0209223 | A1 | 7/2014 | Hashimoto et al. |
| 2018/0087139 | A1 | 3/2018 | Hashimoto et al. |

FOREIGN PATENT DOCUMENTS

| | | | |
|---|---|---|---|
| JP | 10-168553 | | 6/1998 |
| JP | 2000-96174 | A | 4/2000 |
| JP | 2003-118367 | | 4/2003 |
| JP | 3465862 | | 11/2003 |
| JP | 2007-119853 | | 5/2007 |
| JP | 4111651 | | 7/2008 |
| JP | 2012165066 | A1 | 12/2012 |
| JP | 61959448 | | 8/2017 |
| WO | 2012/165086 | A1 | 12/2012 |

OTHER PUBLICATIONS

Wang Zhu-Tang, et al., "Aluminum Material Guide Book for Automobiles" Aluminum Guide Book for Modern Transportation Equipment, 2012, 6 Pages (with English language translation).

* cited by examiner

7XXX SERIES ALUMINUM ALLOY MEMBER EXCELLENT IN STRESS CORROSION CRACKING RESISTANCE AND METHOD FOR MANUFACTURING THE SAME

CROSS-REFERENCE TO RELATED APPLICATIONS

The present application is a divisional of U.S. patent application Ser. No. 14/132,381, filed on Dec. 18, 2013, and claims priority to JP 2013-015456 filed on Jan. 30, 2013.

FIELD OF INVENTION

The present invention relates generally to 7xxx series aluminum alloy members formed by subjecting high-strength 7xxx series aluminum alloy extrudates in at least a region along the longitudinal direction to crushing; and methods for manufacturing the members. Specifically, the present invention relates to a 7xxx series aluminum alloy member having excellent stress corrosion cracking resistance; and a method for manufacturing the member.

BACKGROUND OF INVENTION

Japanese Patent No. 3465862, Japanese Patent No. 4111651, and Japanese Unexamined Patent Application Publication (JP-A) No. H07-25296 describe manufacturing of automobile reinforcement members such as door beams and bumper reinforcements by subjecting an aluminum alloy extrudate to crushing, where the extrudate includes a pair of flanges arranged to face each other and two or more webs connected to the flanges, and the crushing is performed on an edge region of the extrudate in a direction perpendicular to the flange face. Such crushing has been believed to be desirably performed after aging from the viewpoints of working accuracy and cost. Typically, Japanese Patent No. 4111651 describes that crushing is performed after aging on a 6xxx series aluminum alloy extrudate formed through press quenching.

In contrast, 7xxx series aluminum alloy extrudates have inferior formability after aging, and, when subjected to crushing after aging, suffer from cracking in a web undergoing bending deformation, even when the crushing is performed at a low crushing rate (percentage reduction in cross-section height). This is because such 7xxx series aluminum alloy extrudates contain large amounts of alloy elements such as Zn, Mg, and Cu and thereby have higher strengths after aging than those of other alloy series. This tendency is more remarkable in higher alloys. To prevent this, JP-A No. 2003-118367, for example, describes that an extrudate after extrusion in a state of T1 temper is desirably subjected to crushing and subsequently to aging.

The 7xxx series aluminum alloy extrudates, however, undergo hardening due to natural aging and have inferior formability even when they are in state of T1 temper after press quenching and before aging. To improve the formability, reversion treatments have been performed to reduce the strengths of 7xxx series aluminum alloys which have been hardened due to natural aging, as described typically in JP-A No. H07-305151; JP-A No. H10-168553; and JP-A No. 2007-119853.

SUMMARY OF INVENTION

Technical Problem

To be sure, the reversion treatments, when applied to T1-temper 7xxx series aluminum alloy extrudates, help the extrudates to have a lower strength and better formability. However, a practical material including a web with a thickness of from 1.5 to 4 mm, when subjected to crushing, may suffer from cracking outside the bent portion at some crashing rates. The customary reversion treatments fail to solve this disadvantage. In addition, the resulting material disadvantageously suffers from inferior stress corrosion cracking resistance due to high tensile residual stress imparted to the web after crushing.

The present invention has been made under these circumstances, and an object thereof is to prevent cracking of a 7xxx series aluminum alloy member due to crushing and to reduce the tensile residual stress so as to help the member to have better stress corrosion cracking resistance, in which the member is formed by subjecting at least a region of a 7xxx series aluminum alloy extrudate to crushing, where the region locates along a longitudinal direction of the extrudate, and the crushing is performed perpendicularly to the extrusion direction of the extrudate.

Solution to Problem

The present invention provides a 7xxx series aluminum alloy member having excellent stress corrosion cracking resistance. The 7xxx series aluminum alloy member is formed by subjecting a region to crushing, where the region corresponds at least a part of a 7xxx series aluminum alloy extnidate and locates along a longitudinal direction of the extrudate, and the crushing is performed perpendicularly to an extrusion direction of the extrudate, in which the 7xxx series aluminum alloy extrudate has a chemical composition containing Zn in a content of from 3.0 to 8.0 percent by mass; Mg in a content of from 0.5 to 2.5 percent by mass; Cu in a content of from 0.05 to 2.0 percent by mass; Ti in a content of from 0.005 to 0.2 percent by mass; and at least one element selected from the group consisting of: Mn in a content of from 0.01 to 0.3 percent by mass; Cr in a content of from 0.01 to 0.3 percent by mass; and Zr in a content of from 0.01 to 0.3 percent by mass; the chemical composition further contains Al and inevitable impurities; the extrudate comprises two or more sheets; the extrudate is formed through press quenching; the member satisfies conditions as specified by expressions as follows:

$$1.5 \le t \le 4.0$$

$$1.5t \le R \le 10t$$

where t represents a thickness (in mm) of a sheet undergoing largest bending deformation among the two or more sheets; and R represents a minimum value of a bend inner radius (in mm); the member undergoes aging after the crushing; and the member satisfies conditions as specified by Expressions (1) to (3) as follows:

$$Y \le -0.1X + 1.4 \quad (1)$$

$$Y = \sigma_{rs}/\sigma_{0.2} \quad (2)$$

$$X = [\mathrm{Mg}] + [\mathrm{Zn}] \quad (3)$$

where $\sigma_{rs}$ represents a tensile residual stress of the sheet undergoing largest bending deformation after the aging; $\sigma_{0.2}$ represents a 0.2% yield stress of the member after the aging; [Mg] represents a content (in mass percent) of Mg; and [Zn] represents a content (in mass percent) of Zn.

The 7xxx series aluminum alloy member having excellent stress corrosion cracking resistance may be manufactured by a manufacturing method as follows. Specifically, at least the region (the region to be subjected to crushing) of the 7xxx series aluminum alloy extrudate as a work is subjected to a reversion treatment, subjected to the crushing within 72 hours after the reversion treatment to give a member, and the entire member after the crushing is subjected to aging. In the method, the crushing is performed under such a condition as to satisfy the conditions specified by expressions: $1.5 \leq t \leq 4.0$ and $3t/2 \leq R \leq 10t$ (in mm); and the reversion treatment includes the substeps of heating the work at a rate of temperature rise of 0.4° C./second or more; holding the work in a temperature range of from 200° C. to 550° C. for a duration of longer than 0 second; and subsequently cooling the work at a cooling rate of 0.5° C./second or more.

The 7xxx series aluminum alloy extrudate typically includes a pair of flanges arranged to face each other; and at least one web connecting between the flanges. The web generally acts as the sheet undergoing largest bending deformation due to crushing.

Advantageous Effects of Invention

The present invention can provide a 7xxx series aluminum alloy member as follows. The member is formed by subjecting to crushing at least a region of a 7xxx series aluminum alloy extrudate formed through press quenching, where the region lies along a longitudinal direction of the extrudate. The member has a high strength, is resistant to cracking, receives a lower tensile residual stress, and exhibits better stress corrosion cracking resistance.

DETAILED DESCRIPTION OF THE PREFERRED EMBODIMENTS

Figure 1:
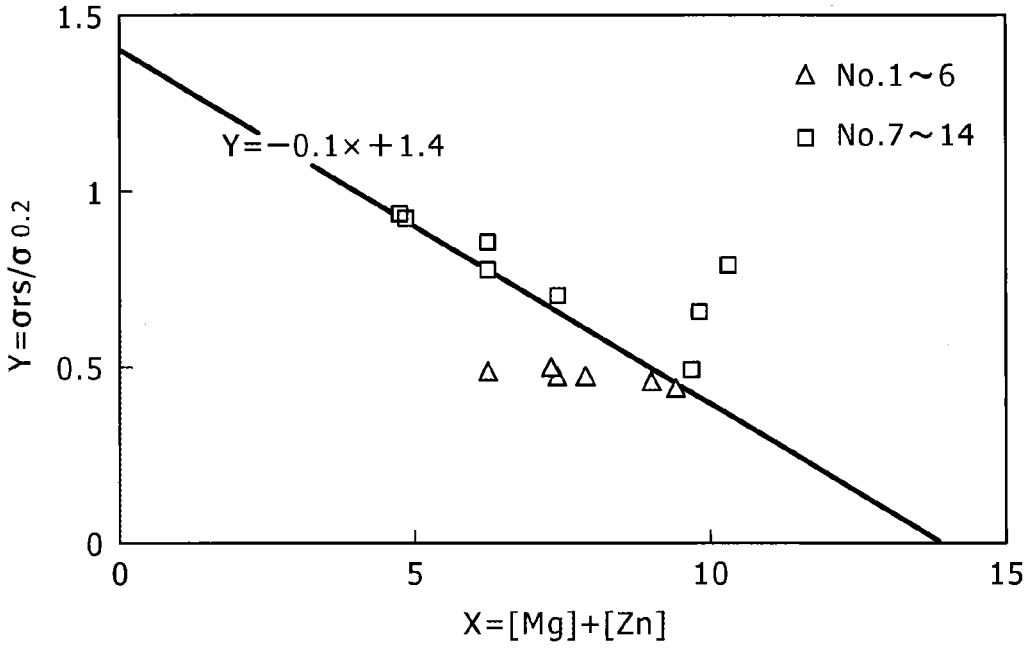
FIG. 1 is a graph indicating how the parameter Y ($=\sigma_{rs}/\sigma_{0.2}$) varies depending on the parameter X (=[Mg]+[Zn]) in 7xxx series aluminum alloy hollow extnidates.

Hereinafter the 7xxx series aluminum alloy member and the manufacturing method thereof according to embodiments of the present invention will be specifically illustrated.

Aluminum Alloy Chemical Composition

Initially, the chemical composition of a 7xxx series aluminum alloy for use in the present invention will be illustrated. However, this chemical composition itself is publicly known as that of 7xxx series aluminum alloys.

Zn: 3.0 to 8.0 percent by mass

Mg: 0.4 to 2.5 percent by mass

Zinc (Zn) and magnesium (Mg) elements form an intermetallic compound $MgZn_2$ to help the 7xxx series aluminum alloy to have higher strengths. Zn contained in a content of less than 3.0 percent by mass, or Mg contained in a content of less than 0.4 percent by mass may fail to help the resulting member to have a yield stress of 200 MPa or more which is necessary as a practical member. In contrast, Zn contained in a content of more than 8.0 percent by mass or Mg contained in a content of more than 2.5 percent by mass may fail to protect the extrudate from cracking due to crushing and fail to reduce the tensile residual stress imparted by the crushing, and this may cause the resulting member to have remarkably inferior stress corrosion cracking resistance, even when the extrudate is subjected to a predetermined reversion treatment prior to the crushing. For higher strengths and a smaller weight, the Zn and Mg contents are preferably higher alloy sides. For example, the Zn and Mg contents are preferably from 5.0 to 8.0 percent by mass and from 1.0 to 2.5 percent by mass, respectively. In this view, the total of Zn and Mg contents is preferably from 6.0 to 10.5 percent by mass.

Cu: 0.05 to 2.0 percent by mass

Copper (Cu) element helps the 7xxx series aluminum alloy to have higher strengths. Cu contained in a content of less than 0.05 percent by mass may fail to contribute to sufficiently higher strengths. In contrast, Cu contained in a content of more than 2.0 percent by mass may cause the hollow extrudate to have inferior extrusion workability. The Cu content is preferably from 0.5 to 1.5 percent by mass.

Ti: 0.005 to 0.2 percent by mass

Titanium (Ti) element effectively contributes to refinement of grains upon casting of the 7xxx series aluminum alloy and thereby improves the formability (crushing workability) thereof. For this reason, Ti is added in a content of 0.005 percent by mass or more. In contrast, Ti contained in a content of more than 0.2 percent by mass may exhibit saturated activities, cause coarse intermetallic compounds to precipitate, and cause reduction in formability contrarily.

Mn: 0.01 to 0.3 percent by mass

Cr: 0.01 to 0.3 percent by mass

Zr: 0.01 to 0.3 percent by mass

Manganese (Mn), chromium (Cr), and zirconium (Zr) elements effectively suppress recrystallization of the 7xxx series aluminum alloy extrudate, allows the grain microstructure to be a fine recrystallized microstructure or fiber microstructure, and helps the member to have better stress corrosion cracking resistance. For these reasons, at least one of these elements may be added within the above-specified ranges.

Inevitable Impurities

Major examples of inevitable impurities in the 7xxx series aluminum alloy include Fe and Si. The contents of Fe and Si are controlled to 0.35 percent by mass or less and 0.3 percent by mass or less, respectively, so as not to degrade properties of the 7xxx series aluminum alloy.

Aluminum Alloy Member Manufacturing Method

The 7xxx series aluminum alloy member according to the present invention may be manufactured by preparing, through press quenching, a 7xxx series aluminum alloy extrudate having the chemical composition and including two or more sheets (generally the prepared extrudate is stored for a duration of from several tens of days to several months); subjecting a region of the extrudate to a reversion treatment, where the region corresponds to the whole or a part of the extrudate and lies along the longitudinal direction of the extrudate; subjecting the region to crushing within 72 hours after the reversion treatment; and then subjecting the entire member to aging, where the crushing is performed perpendicularly to the extrusion direction of the extrudate under such a condition as to satisfy conditions specified by expressions as follows:

$$1.5 \leq t \leq 4.0$$

$$3t/2 \leq R \leq 10t$$

where t represents the thickness (in mm) of a sheet undergoing largest bending deformation among the two or more sheets; and R represents the minimum value (in mm) of bend inner radius. The reversion treatment includes the substeps of heating the work (at least the region) at a rate of temperature rise of 0.4° C./second or more; holding the work in a temperature range of from 200° C. to 550° C. for a duration of longer than 0 second; and subsequently cooling the work at a cooling rate of 0.5° C./second or more.

The material extrudate typically includes a pair of flanges arranged to face each other; and at least one web connecting between the flanges. The extrudate may have a simple hollow (square or rectangle) profile, a double hollow (rectangle with one inside bar) profile, or a triple hollow (rectangle with two inside bars) profile. The flanges may protrude from both sides of the web(s) in the extrudate. The flanges and web(s) are generally each in the form of a sheet; but the term "sheet" as used herein also refers to and includes one having some curvature. When the extrudate is subjected to crushing in such a direction as to allow the pair of flanges to approach each other, the web(s) is a sheet undergoing largest bending deformation (to have a largest curvature). Hereinafter the sheet undergoing largest bending deformation due to crushing is referred to as a "web".

The present invention specifies the thickness t (in mm) of the web in the extrudate at a relatively large level of from 1.5 to 4.0 ($1.5 \leq t \leq 4.0$). This is because the 7xxx series aluminum alloy member according to the present invention may be advantageously used as automobile reinforcement members such as door beams and bumper reinforcements.

The extrudate manufactured through press quenching is hardened due to natural aging and resulting intermetallic compounds precipitation. The reversion treatment performed prior to crushing allows the intermetallic compounds to be dissolved again and helps the extrudate to be softer (more flexible) and to have better formability (crushing workability). This prevents cracking outside the bent portion of the web undergoing bending deformation upon crushing of the extrudate and, in addition, reduces the tensile residual stress generated in the web.

A reversion treatment performed at a rate of temperature rise of less than 0.4° C./second may promote the precipitation of intermetallic compounds during the temperature rise process and may fail to provide sufficient effects. A reversion treatment performed at a holding temperature (actual work temperature) of lower than 200° C. may not help the intermetallic compounds, which have been precipitated due to natural aging, to be dissolved again, but contrarily promote the precipitation thereof to cause the intermetallic compounds to be coarsened. In contrast, a reversion treatment performed at a holding temperature of higher than 550° C. may cause the extrudate to be an annealed aluminum material. In any case, the reversion treatment fails to help the member to have required strengths after aging. The holding should be performed for a duration of longer than 0 second. Specifically, the extrudate after reaching the holding temperature may be held at the holding temperature for a predetermined duration before cooling, or may be cooled immediately. The holding time is not critical in its upper limit, but is desirably shorter for satisfactory production efficiency, and is typically preferably 60 seconds or shorter, more preferably 10 seconds or shorter, and furthermore preferably 5 seconds or shorter. The heating may be performed with a device such as high frequency induction heating equipment or a salt-bath furnace.

A reversion treatment performed through cooling from the holding temperature at a low cooling rate of less than 0.5° C./second may cause intermetallic compounds to precipitate again during the cooling process, and this may cause the reversion treatment to exhibit lower effects or to lose its effects. It should be noted that the customary reversion treatment techniques failed to take the cooling rate during the cooling process into account.

After the reversion treatment, the extrudate is subjected to crushing before the material is hardened again due to natural aging. Specifically, the crushing is preferably performed within 72 hours after the reversion treatment. The crushing is preferably performed at such a crushing rate as to satisfy a condition specified by expressions as follows: $1.5t \leq R$ where R represents the minimum value (in mm) of a bend inner radius of the web after crushing. This can prevent cracking outside the bent portion of the web undergoing bending deformation and can prevent increase in tensile residual stress generated in the web. However, crushing performed at such a crushing rate as to allow R to be less than 1.5t ($R<1.5t$) may fail to prevent cracking outside the bent portion of the web even when the reversion treatment is performed prior to the crushing of the extrudate. This crushing may also fail to prevent increase in tensile residual stress generated in the web and may cause the member to have inferior stress corrosion cracking resistance. In contrast, crushing performed at such a crushing rate as to allow R to be larger than 10t ($R>10t$) may not cause cracking even when the reversion treatment is not performed prior to the crushing of the extrudate (even when the extrudate is in T1 state).

Aging after the crushing may be performed under known conditions as performed in regular 7xxx series aluminum alloys. The aging helps the product 7xxx series aluminum alloy member to surely have a strength (0.2% yield stress) of 200 MPa or more.

The resulting 7xxx series aluminum alloy member manufactured by the manufacturing method, even though being a high-strength member, does not suffer from cracking in the web in a region undergoing crushing and exhibits excellent stress corrosion cracking resistance, because member has X and Y satisfying the condition as specified by Expression (1), where Y is the ratio of the tensile residual stress $\sigma_{sr}$ of the web to the 0.2% yield stress $\sigma_{0.2}$ of the member; and X (=[Mg]+[Zn]) is the total of the Mg content [Mg] and the Zn content [Zn].

The graph illustrated in FIG. 1 depicts plots of data obtained in after-mentioned working examples on X-Y coordinates, where X (=[Zn]+[Mg]) represents the total content of Zn and Mg; and Y ($=\sigma_{rs}/\sigma_{0.2}$) represents the ratio of the tensile residual stress ($\sigma_{rs}$) to the 0.2% yield stress ($\sigma_{0.2}$). The data are plotted by open triangles, and open squares. The line in FIG. 1 is a straight line expressed as $Y=-0.1X+1.4$. In FIG. 1, data plotted by open triangles correspond to Samples Nos. 1 to 6 as Examples. All these data fell within the range of $Y \leq -0.1X+1.4$, and all the corresponding samples exhibited excellent stress corrosion cracking resistance, as demonstrated in Table 2. In contrast, data plotted by open squares correspond to Samples Nos. 7 to 14 and all fell within the range of: $Y>-0.1X+1.4$, and the corresponding samples exhibited poor stress corrosion cracking resistance as demonstrated in Table 2. Samples Nos. 1 to 6 having data falling in the range of: $Y \leq -0.1X+1.4$ did not suffer from cracking in the web; whereas Samples Nos. 7 to 14 having data falling in the range of: $Y>-0.1X+1.4$ suffered from cracking in the web, also as demonstrated in Table 2.

EXAMPLES

Figure 2A:
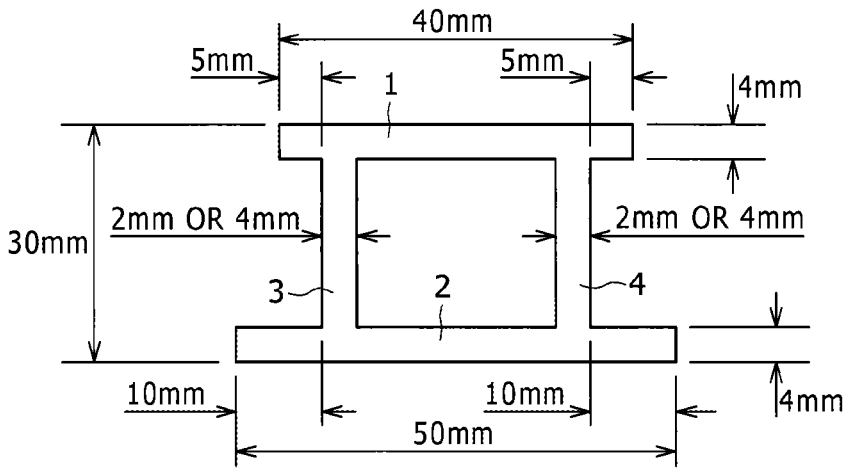
FIGS. 2A and 2B are a cross-sectional view of a 7xxx series aluminum alloy extrudate prepared in working examples; and a side view illustrating how to perform a crushing test, respectively.

7xxx series aluminum alloys given in Table 1 were subjected to hot extrusion, and the extruded articles were air-cooled with a blower (fan) on line (press quenched) immediately after extrusion, and yielded extrudates each of which included a pair of flanges arranged to face each other (inner flange 1 and outer flange 2); and two webs 3 and 4 connecting between the flanges vertically and had a substantially square (simple hollow) profile with protrusions of the flanges, as illustrated in FIG. 2A. Each extrudate simulated a door beam and had a height of 30.0 min, in which the outer flange 1 had a thickness of 4.0 mm and a width of 40.0 mm; the inner flange 2 had a thickness of 4.0 mm and a width of 50.0 mm; and the two webs 3 and 4 each had a thickness of 2.0 mm or 4.0 mm. The outer flange 1 protruded each 5 mm from both sides (right and left sides) of the two webs 3 and 4; and the inner flange 2 protruded each 10 mm from the both sides of the two webs 3 and 4.

The extrudates of Samples Nos. 1 to 14 after press quenching were each cut to a predetermined length, from which two specimens (extrudates) were sampled per each of Samples Nos. 1 to 14, left stand at room temperature for 20 days for natural aging, and subjected to reversion treatments using high frequency induction heating equipment at different rates of temperature rise, end-point temperatures (actual work temperatures), holding durations, and cooling rates as given in Table 1 (Sample No. 11 alone was not subjected to a reversion treatment). Each reversion treatment was performed only on a partial region (edge region) of the specimen along its longitudinal direction.

TABLE 1

| | Chemical composition (in mass percent) | | | | | | | | | | Reversion treatment | | | | |
|---|---|---|---|---|---|---|---|---|---|---|---|---|---|---|---|
| | | | | | | | | | | | Temperature rise rate | End-point temperature | Holding time | Cooling rate | Time until crushing |
| No. | Zn | Mg | Cu | Si | Fe | Ti | Mn | Cr | Zr | Al | (° C./s) | (° C.) | (s) | (° C./s) | (h) |
| 1 | 7.10 | 1.92 | 1.23 | 0.22 | 0.21 | 0.12 | 0.23 | 0.22 | 0.22 | Remainder | 0.5 | 550 | 1 | 0.52 | 71 |
| 2 | 7.90 | 1.55 | 1.43 | 0.20 | 0.21 | 0.13 | 0.21 | 0.22 | 0.21 | Remainder | 0.5 | 550 | 1 | 0.52 | 70 |
| 3 | 5.51 | 1.91 | 0.16 | 0.04 | 0.17 | 0.02 | 0.05 | — | — | Remainder | 0.5 | 500 | 2 | 0.52 | 20 |
| 4 | 5.60 | 0.63 | 0.17 | 0.05 | 0.17 | 0.02 | — | 0.03 | — | Remainder | 0.5 | 500 | 2 | 0.52 | 30 |
| 5 | 6.51 | 0.81 | 0.15 | 0.06 | 0.17 | 0.03 | — | — | 0.05 | Remainder | 0.5 | 450 | 3 | 0.52 | 60 |
| 6 | 6.50 | 1.39 | 0.14 | 0.04 | 0.17 | 0.02 | — | 0.15 | 0.13 | Remainder | 0.5 | 500 | 4 | 0.52 | 71 |
| 7 | 8.13* | 2.16* | 1.11 | 0.22 | 0.21 | 0.11 | 0.21 | 0.20 | 0.21 | Remainder | 0.5 | 200 | 1 | 0.52 | 5 |
| 8 | 7.88 | 1.95 | 1.12 | 0.21 | 0.22 | 0.12 | 0.22 | — | 0.22 | Remainder | 0.5 | 550 | 1 | 0.22* | 5 |
| 9 | 4.32 | 0.52 | 1.00 | 0.22 | 0.23 | 0.10 | 0.21 | — | 0.21 | Remainder | 0.5 | 180* | 1 | 0.52 | 30 |
| 10 | 4.21 | 0.51 | 1.13 | 0.22 | 0.22 | 0.12 | 0.20 | — | 0.20 | Remainder | 0.5 | 200 | 1 | 0.52 | 70 |
| 11 | 5.61 | 0.63 | 0.17 | 0.05 | 0.17 | 0.02 | — | 0.03 | — | Remainder | —* | —* | —* | —* | —* |
| 12 | 7.68 | 1.98 | 1.23 | 0.22 | 0.21 | 0.12 | 0.23 | 0.22 | 0.22 | Remainder | 0.5 | 450 | 2 | 0.52 | 100* |
| 13 | 6.22 | 1.20 | 1.43 | 0.20 | 0.21 | 0.13 | 0.21 | 0.22 | 0.21 | Remainder | 0.1* | 450 | 2 | 0.52 | 40 |
| 14 | 5.60 | 0.63 | 0.17 | 0.05 | 0.17 | 0.02 | — | 0.03 | — | Remainder | 0.5 | 220 | 3 | 0.30* | 10 |

*Out of the range specified in the present invention

Figure 2B:
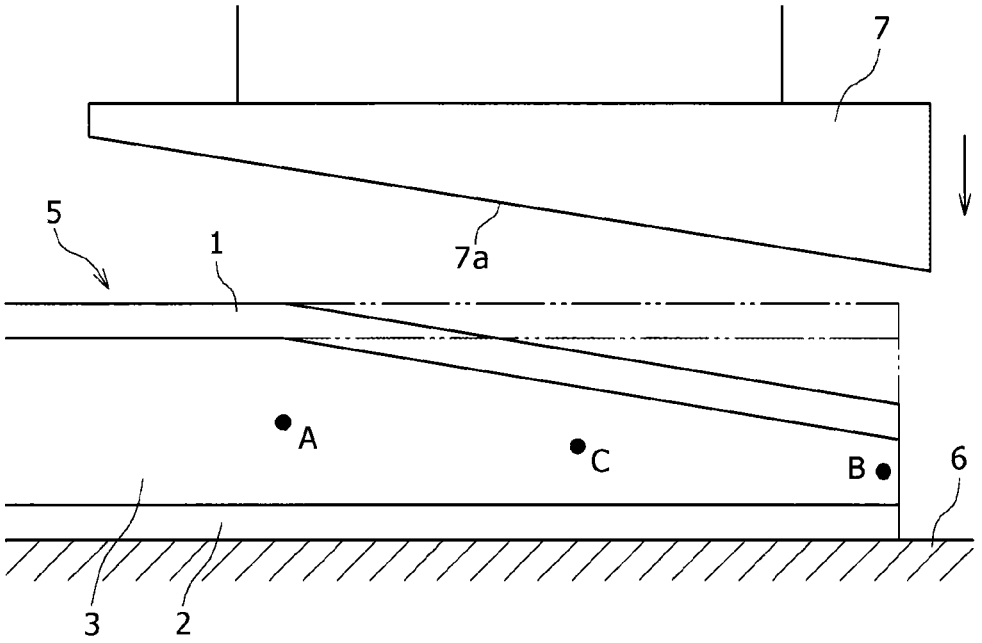

After a lapse of time given in Table 1 after the reversion treatment, the specimen 5 was placed on a horizontal table 6, vertically pressed by a crushing jig 7 arranged above the horizontal table 6, concurrently an inward load was applied to the webs 3 and 4 using a horizontal working jig (not shown; see horizontal loading jig 9 in JP-A No. H07-25296), and the edge region of the specimen 5 undergoing the reversion treatment (only in Sample No. 11, the region had not undergone the reversion treatment) was vertically crushed with a slope 7*a* of the crushing jig 7, as illustrated in FIG. 2B. The crushing caused the webs 3 and 4 of the specimen 5 to undergo bending deformation and to project inward the hollow part. In the crushing, the crushing rate, i.e., the bend radius of the webs 3 and 4 of the specimen 5 (two specimens per each of Samples Nos. 1 to 14) was adjusted by adjusting the position of the specimen 5 in a longitudinal direction (horizontal direction in FIG. 2B) on the horizontal table 6 while moving the crushing jig 7 at a constant stroke.

After the crushing, the entire specimen (two specimens per each of Samples Nos. 1 to 14) was aged at 130° C. for 8 hours.

After the aging, one of the two specimens (corresponding to Samples Nos. 1 to 14) was subjected to a tensile test, an examination on whether cracking occurred outside the bent portion of the webs, measurement of bend inner radius (minimum value R) of the webs, and measurement of web tensile residual stress. The other specimen (corresponding to Samples Nos. 1 to 14) was subjected to a stress corrosion cracking resistance test. The results are indicated in Table 2.

Tensile Test

A JIS No. 5 test specimen was sampled from a region of the specimen 5 where no reversion treatment was applied, and the test specimen was subjected to a tensile test according to the Metallic materials—Tensile testing method—as prescribed in JIS Z 2241 to measure a 0.2% yield stress ($\sigma_{0.2}$).

Cracking Examination

The webs 3 and 4 in the region of the specimen 5 where crushing was applied were visually observed, and whether or not cracking occurred outside the bent portion of the webs 3 and 4 was examined. Cracking, if any, occurred mainly in the vicinity of the edge face of the specimen 5 where crushing was applied.

Bend Inner Radius Minimum Value R

The bend inner radii of the webs 3 and 4 became minimum in the edge face of the specimen 5 where crushing was applied. For this reason, the bend inner radii of the webs 3 and 4 were measured at the edge face.

Web Tensile Residual Stress

The residual stress was measured by a cutting process according to a procedure as follows. As measurement positions, there were selected a crushing starting position A, an edge position B, and an intermediate position C as illustrated in FIG. 2B, where each position is a middle position in height. Each measurement position on its surface was polished with sandpaper, washed with acetone, a strain gauge was bonded to the polished area with an instantaneous adhesive, and the resulting specimen was left stand at room temperature for 24 hours. A lead wire of the strain gauge was connected to a strain meter, zero-point adjustment was performed, a 10-mm square of the work around the strain gauge was cut with a metal saw to relieve stress, a strain ε after cutting was measured, and a residual stress $\sigma_{rs}$ was calculated according to an expression as follows:

$$\sigma_{rs}=-E\times\varepsilon$$

wherein E represents the Young's modulus and is set herein to 68894 N/mm$^2$.

In all the specimens of Samples Nos. 1 to 14, the tensile residual stress measured at the crushing starting position A was a maximum value. This is probably because the material at the crushing starting position A was restrained to the maximum extent; whereas the material at the edge position B and intermediate position C was restrained to a relatively small extent, whereby the strain due to crushing was relieved there. Accordingly, the residual stress $\sigma_{rs}$ measured at the crushing starting position A is indicated in Table 2.

TABLE 2

| No. | Web thickness t (mm) | Bend radius R (mm) | R/t | Presence/absence of cracking | Yield stress after T5 treatment $\sigma_{0.2}$ (MPa) | Residual stress $\sigma_{rs}$ (MPa) | $\sigma_{rs}/\sigma_{0.2}$ (=Y) | [Mg] + [Zn] (=X) (%) | −0.1X + 1.4 | Y ≤ −0.1X + 1.4 | Stress corrosion cracking resistance |
|---|---|---|---|---|---|---|---|---|---|---|---|
| 1 | 2 | 3 | 1.5 | Absent | 452 | 210 | 0.46 | 9.02 | 0.50 | Satisfying | Good |
| 2 | 4 | 6 | 1.5 | Absent | 461 | 204 | 0.44 | 9.45 | 0.46 | Satisfying | Good |
| 3 | 2 | 4 | 2 | Absent | 402 | 192 | 0.48 | 7.42 | 0.66 | Satisfying | Good |
| 4 | 2 | 4 | 2 | Absent | 409 | 201 | 0.49 | 6.23 | 0.78 | Satisfying | Good |
| 5 | 2 | 4 | 2 | Absent | 423 | 212 | 0.50 | 7.32 | 0.67 | Satisfying | Good |
| 6 | 2 | 4 | 2 | Absent | 447 | 215 | 0.48 | 7.89 | 0.61 | Satisfying | Good |
| 7 | 2 | 3 | 1.5 | Present* | 467 | 369 | 0.79 | 10.29 | 0.37 | Unsatisfying* | Poor* |
| 8 | 2 | 3 | 1.5 | Present* | 413 | 273 | 0.66 | 9.83 | 0.42 | Unsatisfying* | Poor* |
| 9 | 2 | 3 | 1.5 | Present* | 194* | 180 | 0.93 | 4.84 | 0.92 | Unsatisfying* | Poor* |
| 10 | 2 | 2.5 | 1.25* | Present* | 205 | 193 | 0.94 | 4.72 | 0.93 | Unsatisfying* | Poor* |
| 11 | 2 | 16 | 8 | Present* | 410 | 354 | 0.86 | 6.24 | 0.78 | Unsatisfying* | Poor* |
| 12 | 2 | 4 | 2 | Present* | 455 | 226 | 0.50 | 9.66 | 0.43 | Unsatisfying* | Poor* |
| 13 | 2 | 4 | 2 | Present* | 370 | 262 | 0.71 | 7.42 | 0.66 | Unsatisfying* | Poor* |
| 14 | 2 | 16 | 8 | Present* | 433 | 341 | 0.79 | 6.23 | 0.78 | Unsatisfying* | Poor* |

*Data out of the range specified in the present invention or evaluated as poor

Stress Corrosion Cracking Resistance

A stress corrosion cracking resistance test was performed by a chromic acid promotion method. Specifically, each of the specimens after crushing was immersed in a test solution at 90° C. for a duration of at longest 16 hours, and whether stress corrosion cracking occurred was visually observed. The test solution was prepared by adding to distilled water 36 g of chromium trioxide, 30 g of potassium dichromate, and 3 g of sodium chloride per 1 liter of the distilled water. In the test, the specimen was taken out from the solution every hour to examine whether cracking occurred or not. A sample suffering from no cracking or suffering from cracking after an elapse of 12 hours or longer was evaluated as having excellent stress corrosion cracking resistance (Good); and a sample suffering from cracking within a duration of shorter than 12 hours was evaluated as having poor stress corrosion cracking resistance (Poor). In any case, the stress corrosion cracking, if any, occurred in the vicinity of the crushing starting position A (see FIG. 2B).

The ratio Y ($=\sigma_{rs}/\sigma_{0.2}$) of the residual stress ($\sigma_{rs}$) to the 0.2% yield stress ($\sigma_{0.2}$) was calculated from these data. The total content X (=[Zn]+[Mg]) of Zn and Mg; and the right-hand value (−0.1X+1.4) of Expression (1) were calculated from the Zn content [Zn] and the Mg content [Mg]. Based on these calculation results, a sample having X and Y satisfying the condition as specified by Expression (1) was evaluated as "Satisfying"; whereas a sample having X and Y not satisfying the condition was evaluated as "Unsatisfying". The results of the calculations and evaluations are indicated in Table 2.

Tables 1 and 2 demonstrate as follows. The specimens of Samples Nos. 1 to 6 each had an alloy chemical composition specified in the present invention, underwent reversion treatment and crushing under conditions specified in the present invention, did not suffer from cracking in the webs after crushing, and had a yield stress after aging of 200 MPa or more. In addition, these specimens had Y ($=\sigma_{rs}/\sigma_{0.2}$) and X (=[Zn]+[Mg]) satisfying the condition as specified in the present invention by Expression (1) and each exhibited excellent stress corrosion cracking resistance.

In contrast, the specimen of Sample No. 7 contained Zn and Mg in excessively high contents and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 8 underwent a reversion treatment performed at an excessively low cooling rate, thereby lost effects of the reversion treatment, and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 9 underwent a reversion treatment performed at an excessively low end-point temperature, failed to enjoy sufficient effects of the reversion treatment, failed to have a higher yield stress even after aging, and failed to protect the webs from cracking due to crushing even though it contained Zn and Mg in relatively low contents. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 10 underwent crushing under such a condition as to give an excessively small R/t (at an excessively high crushing rate) and failed to protect the webs from cracking due to crushing even though it underwent a reversion treatment performed under appropriate conditions and contained Zn and Mg in relatively low contents. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 11 underwent no reversion treatment and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 12 underwent holding between the reversion treatment and crushing for an excessively long duration, thereby lost effects of the reversion treatment, and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 13 underwent a reversion treatment performed at an excessively low rate of temperature rise, thereby failed to enjoy sufficient effects of the reversion treatment, and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

The specimen of Sample No. 14 underwent a reversion treatment performed at an excessively low cooling rate, thereby lost effects of the reversion treatment, and suffered from cracking in the webs due to crushing. In addition, this specimen had Y ($=\sigma_{rs}/\sigma_{0.2}$) and X (=[Zn]+[Mg]) not satisfying the condition as specified in the present invention by Expression (1) and exhibited poor stress corrosion cracking resistance.

What is claimed is:

1. A method for manufacturing a member having a pair of flanges and a web connected to the flanges, a thickness of the web being from 1.5 to 4.0 mm, said method comprising:

subjecting at least a portion of said member to a reversion, said reversion treatment comprising heating said portion at a rate of temperature rise of 0.4° C./second or more, holding said portion in a temperature range of from 200° C. to 550° C. for a duration of longer than 0 second, and subsequently cooling the portion at a cooling rate of 0.5° C./second or more;

crushing at least a portion of said portion that was subject to said reversion treatment in a direction perpendicular to an extrudate direction of an aluminum alloy extrudate within 72 hours after the reversion treatment to satisfy a condition as follows:

$$3t/2 \leq R \leq 10t$$

where

R represents an inside bend radius of the web at the portion after said crushing;

t represents a thickness (in mm) of the web; and subjecting the member after the crushing to aging;

wherein the member is made of an aluminum alloy extrudate comprising:

Zn in a content of from 3.0 to 8.0 percent by mass;

Mg in a content of from 0.4 to 2.5 percent by mass;

Cu in a content of from 0.05 to 2.0 percent by mass;

Ti in a content of from 0.005 to 0.2 percent by mass;

at least one element selected from the group consisting of:

Mn in a content of from 0.01 to 0.3 percent by mass;

Cr in a content of from 0.01 to 0.3 percent by mass; and

Zr in a content of from 0.01 to 0.3 percent by mass; and

Al and inevitable impurities.

2. The method according to claim 1, wherein the aluminum alloy extrudate comprises:

a pair of flanges arranged to face each other; and the web connecting between the flanges; and the web undergoes the largest bending deformation.

3. The method according to claim 1, wherein the web has a thickness of from 1.5 to 4.0 mm.

4. The method according to claim 1, wherein the member further satisfies conditions as follows:

$$Y \leq -0.1X + 1.4$$

$$Y = \sigma_{sr}/\sigma_{0.2}$$

$$X = [Mg] + [Zn]$$

where $\sigma_{sr}$ represents a tensile residual stress of the web at the portion;

$\sigma_{0.2}$ represents a 0.2% yield stress of the member;

[Mg] represents a content of Mg; and

[Zn] represents a content of Zn.

5. The method according to claim 1, wherein said reversion treatment comprises heating at a rate of temperature rise of 0.5° C./second or more; holding in a temperature range of from 450° C. to 550° C. for a duration of longer than 0 second; and subsequently cooling at a cooling rate of 0.5° C./second or more.

6. The method according to claim 1, wherein the aluminum alloy extrudate comprises Zn in a content of from 5.0 to 8.0 percent by mass.

7. The method according to claim 1, wherein the aluminum alloy extrudate comprises Mg in a content of from 1.0 to 2.5 percent by mass.

8. The method according to claim 1, wherein the aluminum alloy extrudate comprises a total content of Zn and Mg of 6.0 to 10.5 percent by mass.

9. The method according to claim 1, wherein the aluminum alloy extrudate comprises Cu in a content of from 0.5 to 1.5 percent by mass.

10. The method according to claim 1, wherein the aluminum alloy extrudate comprises Mn in a content of from 0.01 to 0.3 percent by mass.

11. The method according to claim 1, wherein the aluminum alloy extrudate comprises Cr in a content of from 0.01 to 0.3 percent by mass.

12. The method according to claim 1, wherein the aluminum alloy extrudate comprises Zr in a content of from 0.01 to 0.3 percent by mass.

13. The method according to claim 1, wherein the aluminum alloy extrudate comprises Fe and Si, wherein Fe is in a content of 0.35 percent by mass or less and Si is in a content of 0.3 percent by mass or less.

14. The method according to claim 1, wherein the member has a hollow square or hollow rectangle profile.

15. The method according to claim 1, wherein the member has two webs and a double hollow profile having a rectangle with one inside bar between the webs.

16. The method according to claim 1, wherein the member has two webs and a triple hollow profile having rectangle with two inside bars between the webs.

* * * * *